US005266933A

United States Patent [19]

Frank et al.

[11] Patent Number: 5,266,933

[45] Date of Patent: Nov. 30, 1993

[54] METHOD AND APPARATUS FOR DISPLAYING A SCREEN SEPARATOR LINE

[75] Inventors: David C. Frank, Ossining, N.Y.; Shigeru Matsubara, Yamato; Hiroshi Satoh, Machida, both of Japan; Stephen P. Thompson, Delray Beach, Fla.

[73] Assignee: International Business Machines Corporation, Armonk, N.Y.

[21] Appl. No.: 58,805

[22] Filed: May 4, 1993

Related U.S. Application Data

[63] Continuation of Ser. No. 682,796, Apr. 9, 1991, abandoned.

[51] Int. Cl.[5] ..... G09G 1/14

[52] U.S. Cl. ..... 345/141; 345/144

[58] Field of Search ..... 340/721, 723, 731, 734, 340/735, 748, 749, 750, 799, 751, 747; 364/900

[56] References Cited

U.S. PATENT DOCUMENTS

| | | | |
|---|---|---|---|
| 4,258,361 | 3/1981 | Hydes et al. | 340/721 |
| 4,283,723 | 8/1981 | Bickley et al. | 340/722 |
| 4,539,563 | 9/1985 | Sako et al. | 340/735 |
| 4,695,834 | 9/1987 | Gojo et al. | 340/722 |
| 4,710,762 | 12/1987 | Yamada | 340/799 |
| 4,831,556 | 5/1989 | Oono | 340/723 |
| 4,881,069 | 11/1989 | Kameda et al. | 340/735 |
| 4,953,102 | 8/1990 | Kimura et al. | 340/735 |
| 5,025,396 | 6/1991 | Parks et al. | 340/723 |

OTHER PUBLICATIONS

"IBM Personal System/2 and Personal Computer Bios Interface Technical Reference", 84X1514, first edition (Apr., 1987), specifically, the section entitled "Video Subsystem" found pp. 4–19 through 4–125.

*Primary Examiner*—Alvin E. Oberley
*Assistant Examiner*—S. Saras
*Attorney, Agent, or Firm*—Perman & Green

[57] ABSTRACT

Method and apparatus for displaying a horizontal screen separator line between two screen areas. A first step operates a display screen controller (12) in a split screen mode of operation so as to display a first screen area (3) at an upper portion of a display screen (18) and a second screen area (4) at a lower portion of the display screen. The step of operating further includes a step of reading data from a screen memory (42) and displaying rows of corresponding alphanumeric characters. Each character is displayed as a plurality of image pixels arranged along a first number of horizontal scan lines. A further step displays a horizontal visual separator (2) between a last row of the first screen area and a first row of the second screen area. The step of displaying the horizontal visual separator includes the steps of (a) reading data from the screen memory and beginning a display of a row of corresponding visual separator characters; and (b) terminating the display of the row of corresponding visual separator characters after displaying a second number of horizontal scan lines that is less than the first number of horizontal scan lines.

15 Claims, 4 Drawing Sheets

METHOD AND APPARATUS FOR DISPLAYING A SCREEN SEPARATOR LINE

This is a continuation of copending application Ser. No. 07/682,796 filed on Apr. 9, 1991, now abandoned.

FIELD OF THE INVENTION

This invention relates generally to data processing system operator displays and, in particular, to a method and apparatus for displaying a horizontal screen separator line for delineating a first display screen region from a second display screen region.

BACKGROUND OF THE INVENTION

As an example of a use of a display screen separator line reference is made to the 3270 family of display terminals manufactured by the International Business Machines Corporation. The 3270 family terminal is used as one of a cluster of online display stations, connected to one or more System/370 host computers, and employs a 3270 data stream to interact with host programs (System/370 is a Trademark of the International Business Machines Corporation of Armonk, N.Y.). This type of host-dependent display station is generally referred to as a Mainframe Interactive (MFI) terminal.

Referring to FIG. 1 there is shown a typical MFI display screen 1 being used in an alphanumeric text display mode, as opposed to a graphical display mode. Display screen is divided into two areas by a horizontal separator line 2. A first area is referred to as a display or host data area 3 and a second area is referred to as an Operator Information Area (OIA) 4. The OIA 4 occupies, by convention, a bottom alphanumeric text row of the screen 1. The OIA 4 is employed to display various operating and status indicators that are associated with the terminal operation and with communication with the host computer(s). The separator line 2 visually separates the OIA 4 from the display area 3. For a color display, and by convention in the 3270 family of display terminals, the separator line 2 is displayed as a continuous blue line that is one screen scan line in width.

However, a problem is created if it is desired to emulate the operation and appearance of the 3270 terminal screen display with a data processor, such as a personal computer. By example, it may be desired to emulate the 3270 terminal display with a Personal System/2 data processor having a Video Graphics Array (VGA) display controller (Personal System/2 is a Registered Trademark of the International Business Machines Corporation of Armonk, N.Y.). Also by example, it may be desired to accomplish a 3270 emulation with a data processor that includes an Extended Graphics Adapter (EGA) display controller or that includes an Extended Graphics Array (XGA) display controller operating in a VGA compatibility mode.

The problem arises due to a lack of specialized hardware, on these and other existing display controllers, to create the separator line 2. As a result, no known type of 3270 emulator has accurately emulated a separator line 2 between the display area 3 and the OIA 4.

One possible method of emulating the separator line 2 would be accomplished in an All Points Addressable (APA) graphics mode through the use of software. However, the use of APA for generating the separator line 2 is undesirable in that a visible performance degradation would occur when drawing text characters in APA mode.

A possible approach to emulating the separator line 2 in the alphanumeric text mode would employ an entire alphanumeric row to display the separator line 2. However, in that the 3270 family of terminals employs only a single scan line for the separator line 2, as opposed to the plurality of scan lines that comprise an alphanumeric row, an inconsistent screen appearance would result. Furthermore, it would be undesirable to dedicate an entire alphanumeric row for generating the separator line 2, as this would reduce by one the number of displayable alphanumeric rows in the display area 3.

Another approach, which would add an overscore to the fonts displayed within the OIA 4, is also undesirable for a number of reasons.

It is therefore an object of the invention to provide a method that employs, without modification, existing display controller circuitry to generate a horizontal separator line between two screen areas.

It is a further object of the invention to provide a method for emulating a 3270 screen format on a data processor having a VGA, EGA, or XGA display controller that does not include circuitry specifically provided for generating the separator line.

SUMMARY OF THE INVENTION

The foregoing and other problems are overcome and the objects of the invention are realized by method and apparatus for interposing a horizontal visual separator between two display areas of a display screen. In accordance with a method of the invention the following steps are performed. A first step operates a display screen controller in a split screen mode of operation so as to display a first screen area at an upper portion of the display screen and a second screen area at a lower portion of the display screen. The step of operating further includes a step of reading data from a screen memory and displaying rows of corresponding alphanumeric characters. Each character is displayed as a plurality of image pixels arranged along a first number of horizontal scan lines. A further step of operating displays a horizontal visual separator between a last row of the first screen area and a first row of the second screen area. The step of displaying the horizontal visual separator includes the steps of (a) reading data from the screen memory and beginning a display of a row of corresponding visual separator characters; and (b) terminating the display of the row of corresponding visual separator characters after displaying a second number of scan lines that is less than the first number of scan lines.

The step of terminating includes a step of resetting an address of the screen memory to zero so as to read out a first row of characters of the second screen area beginning at address zero of the screen memory.

The method further includes the steps of displaying at least one row of the second screen area; performing a vertical retrace operation; and resetting an address of the screen memory means to an address greater than zero so as to read out a first row of characters of the first screen area.

The step of reading data from the screen memory and displaying rows of corresponding alphanumeric characters reads (n) rows of alphanumeric characters corresponding to the first screen area and (m) rows of alphanumeric characters corresponding to the second screen area. Letting the first number of scan lines be (x) and the second number of scan lines be (y); the method includes an initial step of programming the display screen controller to display $(((n+m)*x)+y)$ horizontal scan lines.

BRIEF DESCRIPTION OF THE DRAWING

The above set forth and other features of the invention are made more apparent in the ensuing Detailed Description of the Invention when read in conjunction with the attached Drawing, wherein.

DETAILED DESCRIPTION OF THE INVENTION

The invention will be described in the context of an IBM Personal System/2 data processor having a VGA display controller (IBM and Personal System/2 are both Registered Trademarks of the International Business Machines Corporation of Armonk, N.Y.). It should be realized, however, that the teaching of the invention is not to be construed to be limited only this specific embodiment.

Reference is made to a document entitled "IBM Personal System/2 and Personal Computer Bios Interface Technical Reference", 84X1514, first edition (April, 1987), specifically, the section entitled "Video Subsystem" found at pages 4–19 through 4–125.

Figure 1:
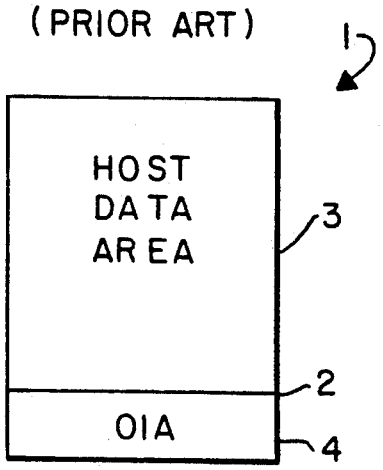
FIG. 1 (PRIOR ART)
FIG. 1 illustrates the format of a 3270 display screen of the prior art.
Figure 2:
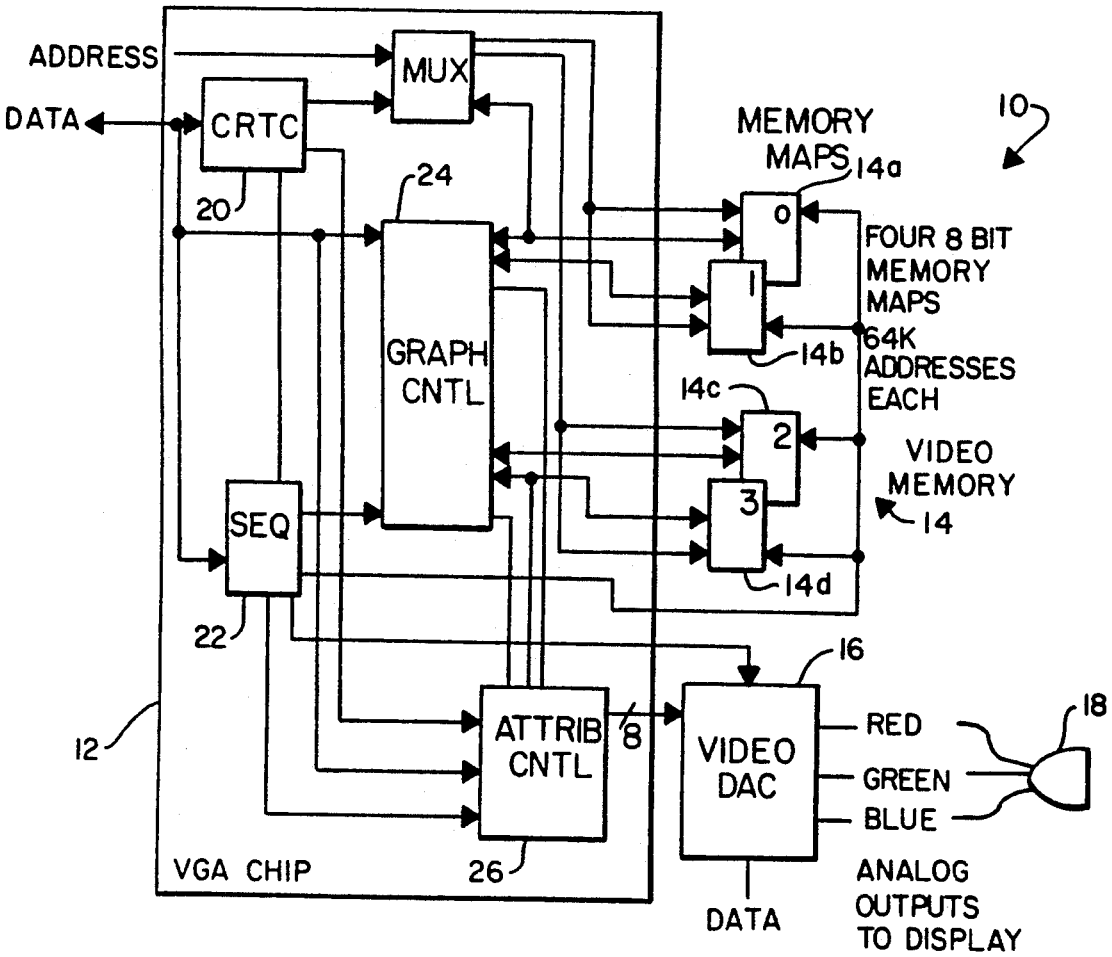
FIG 2 (PRIOR ART)
FIG. 2 is a block diagram illustrating a VGA display controller of the prior art, this display controller being suitable for practicing the method of the invention.

Referring to FIG. 2 there is shown a block diagram of a video subsystem 10. System video is generated by a Video Graphics Array (VGA) 12 and associated circuitry. The VGA 12 is embodied within an ASIC device or chip. The associated circuitry includes a video memory 14 and a video digital-to-analog converter (DAC) 16. 256K bytes of video memory 14 is partitioned into four, 64K by eight memory maps (14*a*–14*d*). Red, green, and blue (RGB) outputs from the video DAC 16 drive a 31.5 kHz direct drive analog display 18.

VGA 12 interfaces to a system microprocessor (not shown) and to the video memory 14. All data passes through the VGA 12 when the system microprocessor writes to or reads from video memory 14. The VGA 12 controls the arbitration for video memory 14 between the system microprocessor and a cathode-ray tube controller (CRTC) 20 contained within the VGA 12.

The VGA 12 operates to format information stored in video memory 14 into an 8-bit digital value that is sent to the video DAC 16. This 8-bit value accesses up to a maximum of 256 registers contained within the video DAC 16. By example, in a 2-color graphics mode, only two different 8-bit values are presented to the video DAC 16. In a 256 color graphics mode, 256 different 8-bit values are presented to the video DAC 16. Each video DAC 16 register contains a color value that is selected from a choice of 256K colors.

It should be noted that the use of a video DAC is not required by the invention. For example, in the EGA mode a digital interface is provided to a monitor and no video DAC is employed. Also, for a conventional monochrome LCD display a video DAC is not required.

The VGA 12 has four major components. These include the CRTC 20, a Sequencer 22, a Graphics Controller 24, and an Attribute Controller 26. The operation of the Graphics Controller 24 is not germane to an understanding of the invention and will not be discussed further.

The CRTC 20 generates horizontal and vertical synchronous timings, addressing for a regenerative buffer, cursor and underline timings, and refresh addressing for the dynamic RAMs that comprise the video memory 14.

The Sequencer 22 generates basic memory timings for the dynamic RAMs and a character clock for controlling regenerative memory fetches. It also permits the system microprocessor to access the video memory 14, during active display intervals, by inserting dedicated system microprocessor memory cycles periodically between the display memory cycles.

The Attribute Controller 26 receives data from the video memory 14 and formats the data for display. Character blinking, underlining, cursor insertion, and PEL panning are controlled by the Attribute Controller 26.

Figure 5:
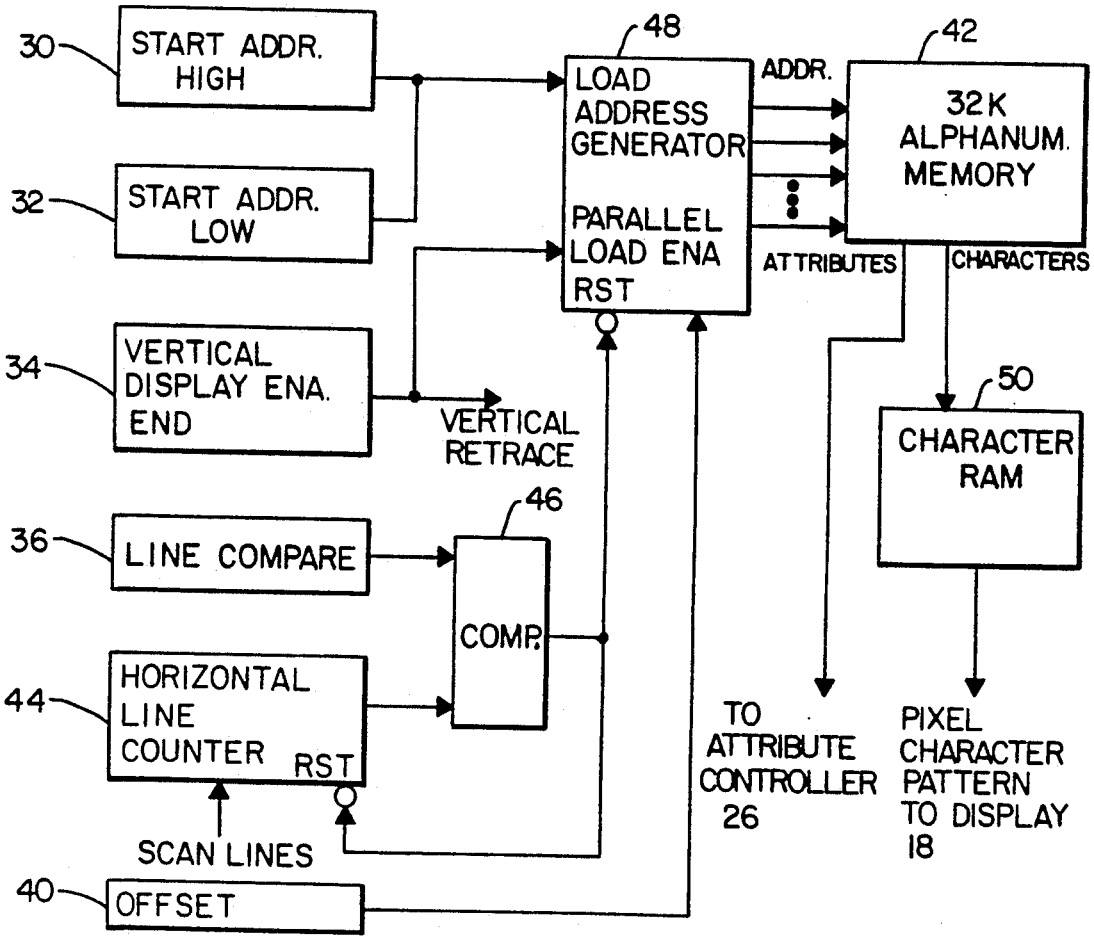
FIG. 5 is a simplified block diagram illustrating portions of the CRTC of FIG. 2 and related circuitry.

Having thus described the general operation of the video subsystem 10 there are now described, in reference to FIG. 5, several CRTC 20 registers out of the 25 registers contained with the CRTC. The registers described below are those used to accomplish the method of the invention.

START ADDRESS HIGH REGISTER 30

This is a read/write register pointed to when a value in a CRTC Address register is hex OC. Bits 7-0 are the high order eight bits of a video memory 14 starting address.

START ADDRESS LOW REGISTER 32

This is a read/write register pointed to when the value in the CRTC Address register is hex OD.

A 16-bit value defined by the contents of the two above referenced registers 30 and 32 is a first video memory 14 address used after a horizontal scan line comparison function is satisfied. That is, these two registers point to a video memory 14 address containing data that is to be displayed at the beginning of the top character row on the screen. Subsequent video memory 14 accesses occur sequentially from this starting address.

VERTICAL DISPLAY ENABLE END REGISTER 34

This is a read/write register pointed to when the value in the CRTC Address register is hex 12. Bits 7-0 of this register are the low order bits of a 10 bit register that defines a vertical display enable end position. High order bits 8 and 9 are found in other registers, although for the purposes described herein all 10 bits are considered to be one register. This register specifies which scan line ends the active video area of the display screen and when a vertical retrace occurs. This register is programmed with the total number of scan lines minus one.

LINE COMPARE REGISTER 36

This is a read/write register pointed to when the value in the CRTC Address register is hex 18. Bits 7-0 of this register are the low order bits of a ten bit register that defines a line compare target. High order bits 8 and 9 are found in other registers, although for the purposes described herein all 10 bits are considered to be one register. When a horizontal line counter 44 reaches the value stored in the Line Compare Register 36 the line counter 44 is reset to zero and a memory address counter is reset to zero.

OFFSET REGISTER 40

This is a read/write register pointed to when the value in the CRTC Address register is hex 13. Bits 7-0 of this register define a logical line width of the display screen 18. A starting memory address for a next character row is determined to be larger than the current character row by either two or four times the value stored in the offset register 40. By example, for each memory location storing an alphanumeric character there is an associated contiguous location that stores an attribute associated with the character.

Figure 3:
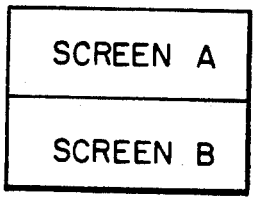
FIG. 3 (PRIOR ART)
FIG. 3 illustrates a display screen being operated in a split-screen mode.

In order to emulate the 3270 display screen on the above referenced data processor a split screen mode, shown in FIG. 3, is employed. One screen portion (A) displays the display area 3 and the other screen portion (B) displays the OIA 4. A technique to create a split screen is described in the aforementioned technical reference at pages 4–113 to page 4–114.

Figure 4:
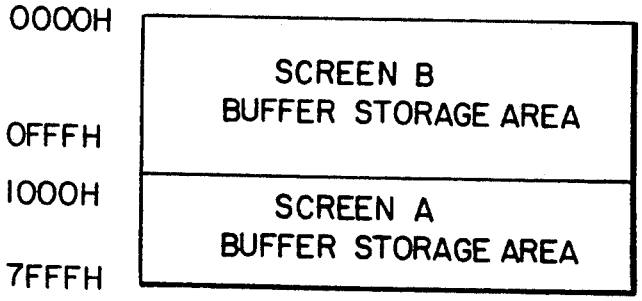
FIG. 4 (PRIOR ART)
FIG. 4 illustrates a video memory organization for achieving the split screen mode of FIG. 3 with the display controller of FIG. 2.

FIG. 4 illustrates the screen mapping for a system containing a 32K byte alphanumeric memory 42. It is noted that in the alphanumeric mode of operation that the alphanumeric memory 42 is comprised of all or a part of the video memory 14. Information displayed on screen A is defined by the Start Address High and Low registers 30 and 32 of the CRTC 20. Information displayed on screen B always begins at address zero in the alphanumeric memory 42.

The line compare register 36 of the CRTC 20 is used to perform the split screen function and is programmed to coincide with the end of screen A. The CRTC 20 includes an internal horizontal scan line counter 44. The CRTC 20 also includes logic 46 that compares the horizontal scan line counter value to the line compare register 36 value and clears an alphanumeric memory address generator 48 when a comparison occurs. The address generator 48 then sequentially addresses the alphanumeric memory 42 starting at location 0, and each subsequent row address is determined by a 16-bit addition of a content of a start of line latch and the contents of the offset register 40. Thus, to achieve the split screen example depicted in FIG. 3, the alphanumeric memory 42 is organized as in FIG. 4; the start address high and low registers 30 and 32 are programmed to point to alphanumeric memory 42 location 1000H, and the line compare register 36 is programmed so as to cause the CRTC 18 to first read out screen A data, and then screen B data.

In accordance with the invention this split screen mode of operation, as described in the aforementioned technical reference, is modified to display the horizontal separator line 2 between screen A, used as the host data area 3, and screen B, used as the OIA 4.

Figure 6:
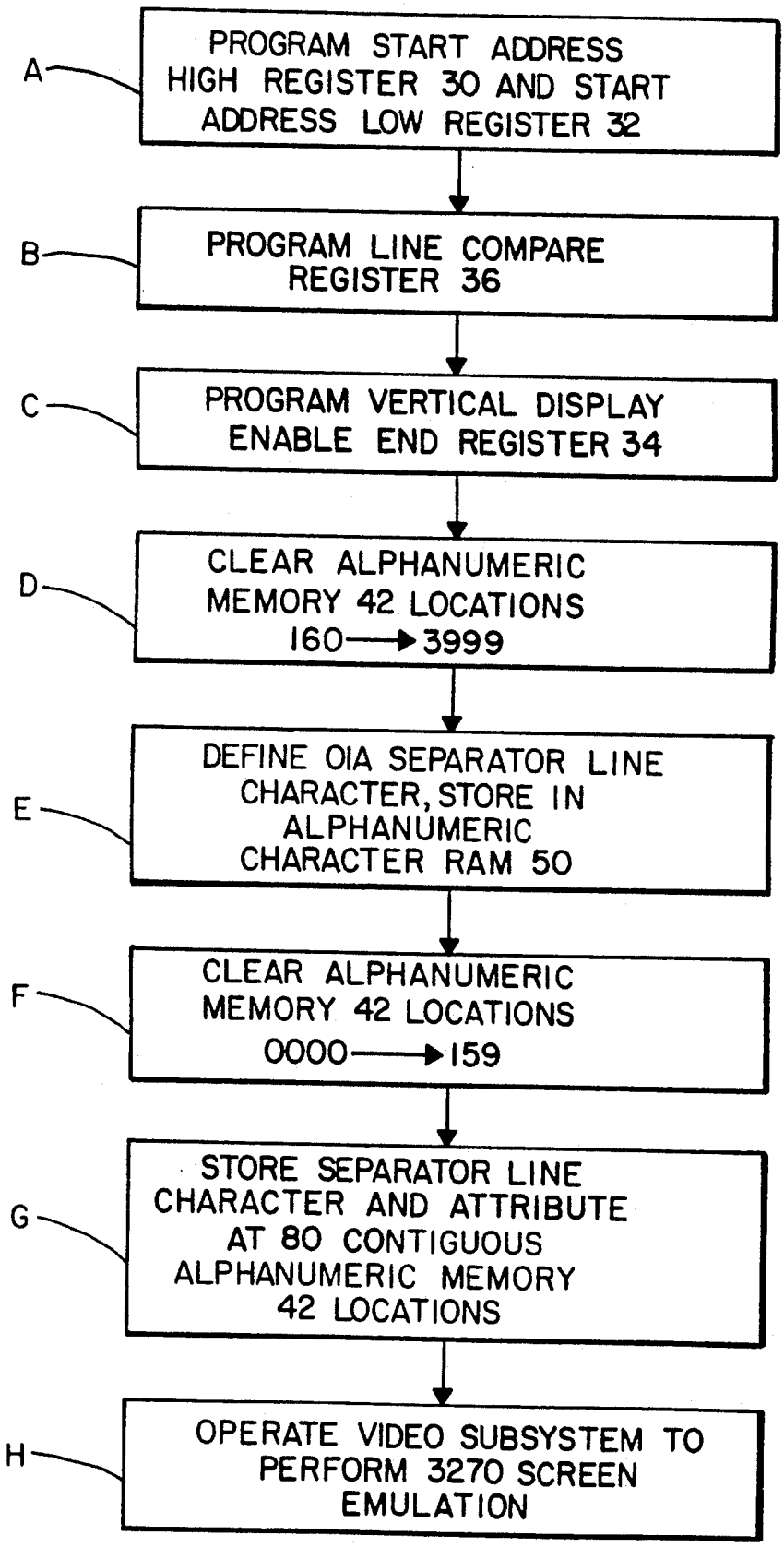
FIG. 6 (A–H) is a flow chart depicting steps of a method of the invention.
Figure 7:
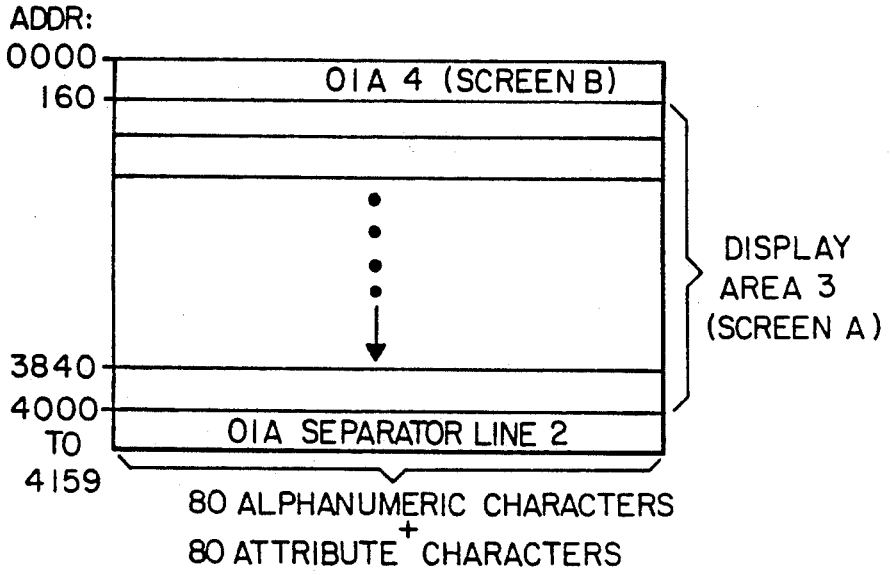
FIG. 7 illustrates an organization of data within an alphanumeric memory as a result of the method of FIG. 6.

FIG. 6 depicts a flowchart for a specific programming sequence that assumes the following system parameters: a VGA display screen area of 720×400 pixels, a 9×16 pixel character cell, and 80 columns by 25 rows of alphanumeric characters. FIG. 7 depicts the organization of the alphanumeric memory 42 that results from the execution of the method expressed in the flowchart of FIG. 6.

At Block A the start address high register 30 and the start address low register 32 are programmed to a value of 160 (80 chars×2). This defines the beginning address of screen A, the host data area 3.

At Block B the line compare register 36 is programmed to 387. This value represents 24 rows times 16 scan lines per row, plus three scan lines allocated for the separator line 2. For this embodiment the separator line 2 is interposed between two blank scan lines. If three blank scan lines are desired, such as two blank scan lines above the separator line 2 and one blank scan line below, the line compare register 36 is instead programmed with 388.

It should be noted that the separator line 2 is formed from a partially scanned character cell. That is, if a normal character cell is nine pixels wide and 16 pixels, or scan lines, high, only three or four of these scan lines are displayed before the content of the line compare register 36 results in a comparison with and a resetting of the horizontal line counter 44. This premature termination of the display of the character row representing the OIA separator line 2 is an important feature of the invention.

At Block C the vertical display enable end register 34 is programmed to a value of 403, or 404 in some embodiments as will be described. This programmed value adds three or four additional scan lines to the normal 400 scan lines that are displayed. The additional three or four scan lines are employed for the separator line 2 and at least one blank scan line on each side of the separator line 2.

In general, the vertical display enable register 34 is programmed to a value equal to $(((n+m)*x)+y)$ horizontal scan lines, where (n) is the number of rows of alphanumeric characters corresponding to the host display area 3, (m) is the number of rows of alphanumeric characters corresponding to the OIA 4, (x) represents a number of horizontal scan lines per character cell, such as 16, and where (y) represents the number of scan lines, such as 3, to form the separator 2. In accordance with the invention ($y<x$). The symbol (*) denotes multiplication.

At Block D an 80×24 character screen window is cleared in the alphanumeric memory 42. This cleared area corresponds to the host data area 3. It is noted that this step is optional.

At Block E the OIA separator line character is defined and a desired pixel pattern is programmed into the corresponding location of a 256 location character RAM 50. This pixel pattern is defined by a continuous horizontal line eight pixels in length and having at least one blank pixel line above and below the horizontal line. This pattern is stored within the eight bit wide character RAM 50 at a location within the range of $CO_{16}$ to $DF_{16}$. For example, the location $DF_{16}$ stores a character not normally used by 3270 emulators. Significantly, this range of character RAM 50 addresses defines a region operated on by a "ninth-dot algorithm". The ninth-dot algorithm is a feature of the VGA display controller 12 that displays a ninth-dot of a 9×16 character cell so as to be identical to the eighth dot. This enables horizontally continuous graphical line characters and the like to be displayed. At other than this address region of the character store RAM the ninth-dot algorithm does not operate and the ninth-dot of each displayed character is blanked, thereby providing at least one blank pixel between adjacent alphanumeric characters. This feature of the VGA display controller 12 is described in further detail in the above referenced technical reference at pages 4–102 and 4–103, in regard to Bit 2 of a CRTC 18 Attribute Mode Control Register.

At Block F an 80 character by one row character screen window is cleared in the alphanumeric memory 42, starting at address zero. This cleared area corresponds to the OIA 3 and consumes the first 160 memory locations. It is noted that this step is also optional.

At Block G 80 copies of the separator line character ($DF_{16}$), and an attribute of $01_{16}$ associated with each of the characters, are stored in the alphanumeric memory 42 at memory locations 4000–4159. The value of the attribute character is selected so that the associated separator line character is displayed as a blue line. Location 4159 is the last location used in the alphanumeric memory 42, and is 160 locations greater than an amount of memory normally employed to display a screen of 80×25 alphanumeric characters. These additional 160 locations contain the 80 copies of the separator line character 2 and the associated attribute characters.

After these preliminary initialization steps (A-G), at Block H the video subsystem 10 is operated to repetitively read-out alphanumeric memory 42 locations 160 to 4159 and 0 to 159 so as to form a split screen image that includes the separator line 2. During use, host data is stored in the host data area 3 (locations 160–3999) and data for the OIA 3 is stored at locations 0 to 159.

Figure 8:
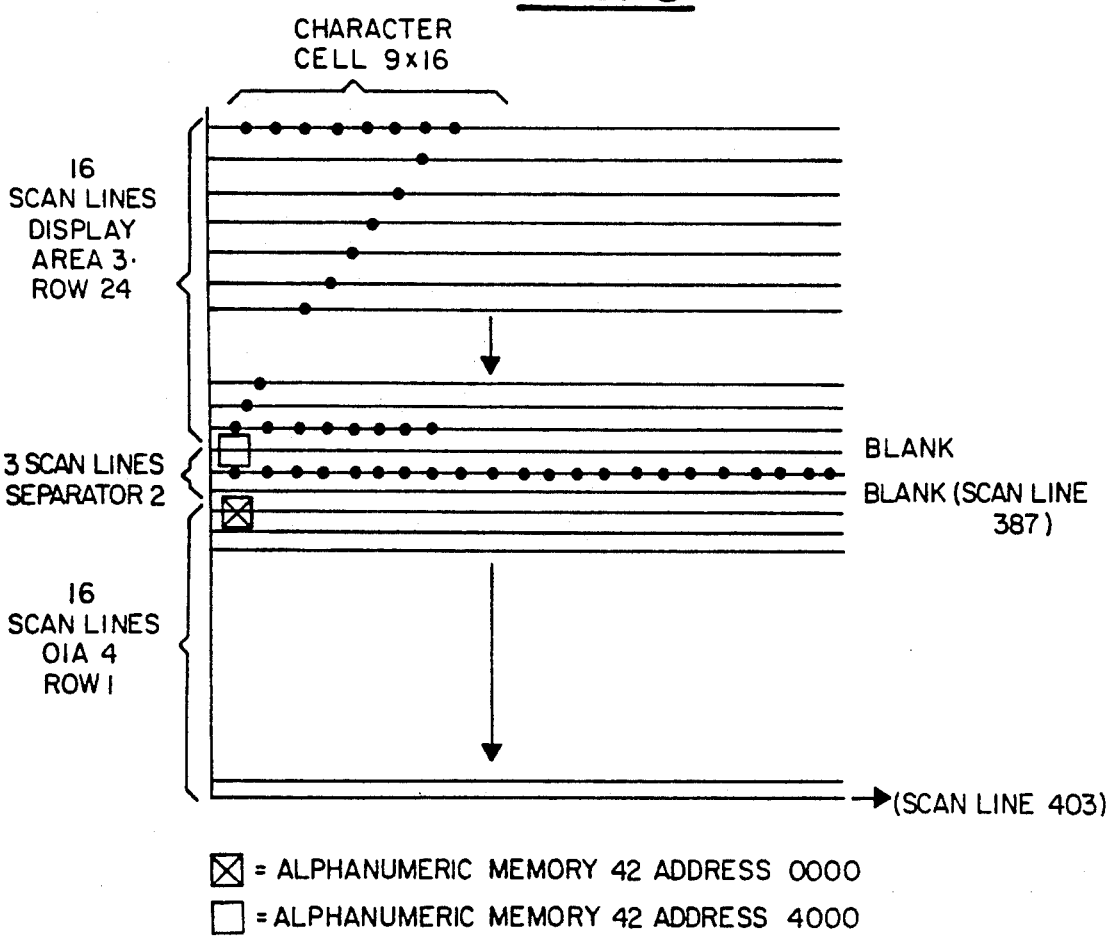
FIG. 8 depicts a portion of the display screen showing a portion of the last character row of the host data area, a portion of the OIA separator line, and a portion of the OIA.

FIG. 8 shows the separator line 2 displayed between the last line of the display area 3 (screen A) and the OIA 4 (screen B).

It should be realized that the invention has been described in the context of a specific embodiment thereof and that the teaching of the invention is not to be construed to being limited to only this specific embodiment. For example, the steps of the method of the invention expressed in FIG. 6 may be executed in other than the order shown while still obtaining the same result. Furthermore, the teaching of the invention applies to other video subsystem hardware embodiments, to rows composed of more or less than 80 alphanumeric characters, to character cells having other than a 16×9 pixel organization, and to other than 720×400 VGA displays. Also, if desired the separator line 2 could be made to be more than one horizontal pixel line in width, could be displayed other than as a continuous, unbroken line, and may be displayed in any color or shade of gray. For these other embodiments specific programming values other than those described above may need to be employed, but the derivation of these values is within the capability of one skilled in the art when guided by the teaching explained in detail above.

Thus, the invention has been particularly shown and described with respect to a preferred embodiment thereof, and it will be understood by those skilled in the art that changes in form and details may be made therein without departing from the scope and spirit of the invention.

Having thus described our invention, what we claim as new, and desire to secure by letters patent is:

1. A method of interposing a horizontal visual separator between two display areas of a display screen, comprising the steps of:

operating a display screen controller in a split screen mode of operation so as to display a first screen area at an upper portion of the display screen and a second screen area at a lower portion of the display screen; the step of operating including the steps of, reading data from a screen memory means and displaying one or more rows of corresponding alphanumeric characters within the first screen area, each alphanumeric character being displayed as a plurality of image pixels arranged along a first number of horizontal display screen scan lines; and displaying a horizontal visual separator between a last row of the first screen area and a first row of the second screen area, the step of displaying the horizontal visual separator including the steps of, reading data from the screen memory means and beginning a display of a row of corresponding visual separator characters; and terminating the display of the row of corresponding visual separator characters after displaying a second number of horizontal display screen scan lines, the second number of horizontal display screen scan lines being less than the first number of horizontal display screen scan lines, wherein the step of terminating includes an initial step of comparing a total number of displayed horizontal display screen scan lines to a predetermined number of displayed horizontal display screen scan lines, the predetermined number of displayed horizontal display screen scan lines being equal to the first number of horizontal display screen scan lines times a number of rows of alphanumeric characters displayed within the first screen area, plus the second number of horizontal display screen scan lines, and wherein the step of terminating is executed in response to the step of comparing indicating equality.

2. A method as set forth in claim 1 wherein the step of terminating includes a step of resetting an address of the screen memory means to zero so as to read out a first row of characters of the second screen area beginning at address zero of the screen memory means.

3. A method as set forth in claim 2 and including the steps of:

displaying at least one row of the second screen area;

performing a vertical retrace operation; and resetting an address of the screen memory means to an address greater than zero so as to read out a first row of characters of the first screen area.

4. A method as set forth in claim 1 wherein the step of reading data from the screen memory means and displaying rows of corresponding alphanumeric characters displays 24 rows of alphanumeric characters corresponding to the first screen area and one row of alphanumeric characters corresponding to the second screen area.

5. A method as set forth in claim 1 wherein the step of reading data from the screen memory means and displaying rows of corresponding alphanumeric characters displays n rows of alphanumeric characters corresponding to the first screen area and m rows of alphanumeric characters corresponding to the second screen area, wherein the first number of display screen scan lines is x, wherein the second number of display screen scan lines is y, and wherein the method includes an initial step of programming the display screen controller to display (((n+m)*x)+y) horizontal display screen scan lines.

6. A method of operating a display screen in an alphanumerics mode of operation to display a visual separator between two display screen areas, comprising the steps of:

reading stored data representing alphanumeric characters from a memory means and displaying corresponding alphanumeric character images upon the display screen within a first display screen area, each of the alphanumeric character images being displayed with pixels arranged on a first number x of horizontal scan lines;

after a final horizontal scan line is displayed within the first screen area, reading stored data representing a visual separator from the memory means and displaying pixels corresponding to visual separator images horizontally across the display screen at a region contiguous with the final horizontal scan line of the first display screen area, the display of the pixels corresponding to the visual separator images being terminated after displaying a second number y of horizontal scan lines, wherein $y<x$, and wherein the display of the pixels corresponding to the visual separator images is terminated in response to a step of determining an equality between a total number of displayed horizontal scan lines an a predetermined number of displayed horizontal scan lines, the predetermined number of horizontal scan lines being equal to x times a number of rows of alphanumeric character images displayed within the first screen area, plus y; and after the y horizontal scan lines are displayed within the region, reading stored data representing alphanumeric characters from the memory means and displaying corresponding alphanumeric character images upon the display screen within a second display screen area that is contiguous with the $y^{th}$ scan line of the region, each of the alphanumeric character images being displayed within the second display screen area with pixels arranged on the first number x of horizontal scan lines.

7. A method as set forth in claim 6 wherein the first step of reading displays 24 rows of alphanumeric characters and wherein the third step of reading displays one row of alphanumeric characters.

8. A method as set forth in claim 6 wherein the first step of reading displays n rows of alphanumeric characters and wherein the third step of reading displays m rows of alphanumeric characters; and wherein the method includes an initial step of programming a display controller means to display (((n+m)*x)+y) horizontal scan lines.

9. A method as set forth in claim 6 and including the initial steps of:

storing the data representing alphanumeric characters that are displayed within the first screen area within the memory means at address locations within a first range of addresses, the first range of addresses beginning at an address that is greater than an initial address of the memory means;

storing the data representing alphanumeric characters that are displayed within the second screen area within the memory means at address locations within a second range of addresses, the second range of addresses beginning at the initial address; and storing data representing the visual separator within the memory means at address locations within a third range of addresses that begins after a last address location of the first range of addresses.

10. A method as set forth in claim 6 wherein the method includes an initial step of storing a pixel pattern that represents the visual separator, the pixel pattern being stored within the memory means with a pattern that results in the display of a continuous horizontal line of illuminated pixels that is interposed between at least one first horizontal line of nonilluminated pixels and at least one second horizontal line of nonilluminated pixels.

11. A method as set forth in claim 10 wherein pixel pattern that includes a continuous horizontal line of pixels is displayed as a horizontal line having the color blue.

12. A method as set forth in claim 6 wherein the method emulates the operation of a 3270 family of display terminals, wherein the first display screen area displays information corresponding to a host data area, and wherein the second display screen area displays information corresponding to an operator information area.

13. Apparatus for interposing a horizontal visual separator between two display areas of a display screen, comprising:

display screen controller means including means for operating in a split screen mode of operation so as to display a first screen area at an upper portion of the display screen and a second screen area at lower portion of the display screen; the operating means including, means for reading data from a screen memory means and for displaying rows of corresponding alphanumeric characters, the screen memory means storing representations of the alphanumeric characters and also storing representations of a horizontal screen separator, each row of alphanumeric characters being displayed with a plurality of image pixels arranged along a first number of display screen horizontal scan lines; and means for displaying the horizontal visual separator between a last row of the first screen area and a first row of the second screen area, the means for displaying the horizontal visual separator including, means, responsive to the operation of the means for reading data from the screen memory means displaying the screen separator with a second number of display screen horizontal scan lines that is less than the first number of display screen horizontal scan lines, for terminating the display of the visual separator, wherein said terminating means includes means for comparing a total number of displayed horizontal display screen scan lines to a predetermined number of displayed horizontal display screen scan lines, the predetermined number of displayed horizontal display screen scan lines being equal to the first number of horizontal display screen scan lines times a number of rows of alphanumeric characters displayed within the first screen area, plus the second number of horizontal display screen scan lines, and wherein said terminating means is responsive to said comparing means indicating equality.

14. Apparatus as set forth in claim 13 wherein the means for terminating includes means for resetting an address of the screen memory means to zero so as to read out a first row of characters of the second screen area beginning at address zero of the screen memory means.

15. Apparatus as set forth in claim 14 and including:

means for displaying at least one row of the second screen area;

means for performing a vertical retrace operation; and means for resetting an address of the screen memory means to an address greater than zero so as to read out a first row of characters of the first screen area.

* * * * *